US008246386B1

(12) United States Patent
DeVito et al.

(10) Patent No.: US 8,246,386 B1
(45) Date of Patent: Aug. 21, 2012

(54) ADAPTED MODULAR CONNECTOR

(76) Inventors: Vince DeVito, Union, NJ (US); Joel Cohn, Union, NJ (US); Scott Sokoli, Union, NJ (US)

( * ) Notice: Subject to any disclaimer, the term of this patent is extended or adjusted under 35 U.S.C. 154(b) by 0 days.

(21) Appl. No.: 13/420,273

(22) Filed: Mar. 14, 2012

Related U.S. Application Data

(60) Provisional application No. 61/454,887, filed on Mar. 21, 2011.

(51) Int. Cl.
*H01R 24/00* (2011.01)

(52) U.S. Cl. ..... 439/626

(58) Field of Classification Search ..... 439/626, 439/607.01, 607.41, 686, 541.5, 695, 660, 439/374, 569
See application file for complete search history.

(56) References Cited

U.S. PATENT DOCUMENTS 5,681,185 A * 10/1997 Briski et al. ..... 439/626
5,812,660 A * 9/1998 Suzuki et al. ..... 379/438
6,354,870 B1 * 3/2002 Timmerman ..... 439/569
7,442,057 B2 * 10/2008 Ko ..... 439/101
2010/0248549 A1 * 9/2010 Lim ..... 439/626
2011/0195593 A1 * 8/2011 McGrath et al. ..... 439/345

* cited by examiner

*Primary Examiner* — Jean F Duverne
(74) *Attorney, Agent, or Firm* — QuickPatents, Inc.; Kevin Prince

(57) ABSTRACT

An electrical connector for connecting a circuit board to a plug of an electric cable that has at least one electrical conductor includes a rigid housing that has at least a front end, a lower end adapted for mounting to the circuit board, and a rear end. A rigid insert is adapted to fit within the housing and includes an open front end adapted to receive the plug of the electric cable. A plurality of lower rear conductors and optionally upper rear conductors project away from the rear end of the insert. A plurality of insert conductors are adapted to convey electrical signals between the conductors of the plug and the plurality of rear conductors. A modifier circuit board is adapted for attachment to the insert and for modifying electrical signals between the rear conductors of the insert through a modifier circuit.

20 Claims, 5 Drawing Sheets

ADAPTED MODULAR CONNECTOR

CROSS-REFERENCE TO RELATED APPLICATIONS

This application claims the benefit of U.S. Provisional Patent Application 61/454,887, filed on Mar. 21, 2011, and incorporated herein by reference.

STATEMENT REGARDING FEDERALLY SPONSORED RESEARCH AND DEVELOPMENT

Not Applicable.

FIELD OF THE INVENTION

This invention relates to electrical connectors, and more particularly to an electrical connector that may be readily adapted for altering electrical signals therethrough, such as to filter EMI and RFI signals or suppress electrical voltage.

BACKGROUND

Electrical connectors for electrical cables are well known in the art. Such cables typically have a plurality of electrical conductors that terminate at a plug adapted to mechanically and electrically attach to the connector.

Often the signals on such electrical conductors need to be modified for a particular application, such as filtering particular frequencies therefrom with an arrangement of capacitors, for example. Frequently the modifying circuit components are fixed directly to the printed circuit board to which the connectors are attached, taking up valuable "real estate" on such PCB boards. In some prior art devices, the connector itself includes signal modification electrical components. However, in all prior art arrangements these signal modification electrical components are difficult and expensive to attach or assemble to the connector initially, or change at any time if the application for the connector varies. Further, manufacturers of such electrical connectors are required to provide a large number of different variations of electrical connectors for many different applications and customer requirements.

Therefore, clear there is a need for an electrical connector that facilitates the modification of electrical signals received by or transmitted through an electrical connector. Electrical filtering or voltage suppression, for example, would be readily added to signal lines of such a needed connector by attaching an appropriate modifier circuit board to the connector, eliminating the necessity of adding modifying components directly to the circuit board and thereby preserving space on the main PCB and reducing the number of modified PCBs necessary. Such a needed connector would allow manufacturers to easily and inexpensively produce only a small number of different connectors and as many modifier circuit boards as necessary for the varied applications of their customers. The present invention accomplishes such objectives.

SUMMARY OF THE INVENTION

The present device is an electrical connector for connecting a circuit board, or PCB, to a plug of an electric cable that has at least one electrical conductor, such as but not limited to a USB cable, an HDMI cable, an audio cable, a DC power cable, an RCA-type cable, or the like. The electrical connector includes a rigid housing that has at least a front end, a lower end adapted for mounting to the circuit board, and a rear end.

A rigid insert is adapted to fit with or within the housing and includes an open front end adapted to receive the plug of the electric cable. A plurality of lower rear conductors project away from the rear end of the insert. A plurality of insert conductors are adapted to convey electrical signals between the conductors of the plug and the plurality of lower rear conductors, and may traverse the insert or be fixed to an outside surface thereof.

A modifier circuit board is adapted for attachment to the rear end of the insert and for modifying electrical signals between the lower rear conductors of the insert through a modifier circuit. The term circuit board used herein may refer to a rigid or flexible substrate having circuit components applied thereto or thereon through printing, etching, soldering, or the like.

In one embodiment, the insert includes at least one indexing prong projecting away from the rear end of the insert, and the modifier circuit board includes a cooperative indexing aperture adapted to receive the indexing prong of the insert for facilitating proper alignment of the modifier circuit board with the lower rear conductors. In one embodiment, the insert further includes a plurality of upper rear conductors projecting away from the rear end of the insert. In such an embodiment, the lower rear conductors may not necessarily be connected directly to associated electrical conductors of the electric cable, but may be more considerably modified by the modifier circuit, such as with an inductive choke device, diode device, or other electrical component.

In use, with the insert fixed with the housing and the modifier circuit board fixed with the rear end of the insert, and with the housing and the lower rear conductors fixed with the circuit board, the electrical signals from the electric cable plugged into the connector are conveyed to the circuit board as modified by the modifier circuit.

The present invention facilitates the modification of electrical signals received by or transmitted through an electrical connector. Electrical filtering and/or voltage suppression, for example, can be readily added to signal lines of such a connector by attaching an appropriate modifier circuit board to the connector, eliminating the necessity of adding modifying components directly to the circuit board, or PCB, thereby preserving space on the PCB and reducing the number of different PCB designs required. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
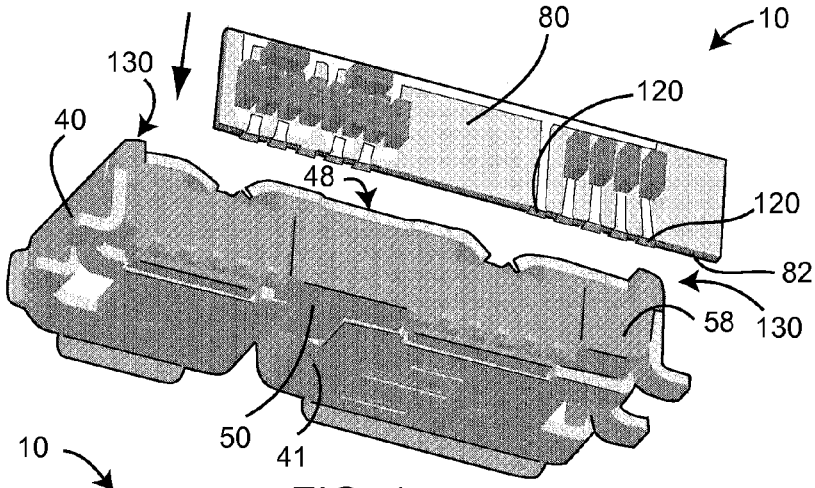
FIG. 1 is an exploded rear perspective view of the invention.
Figure 2:
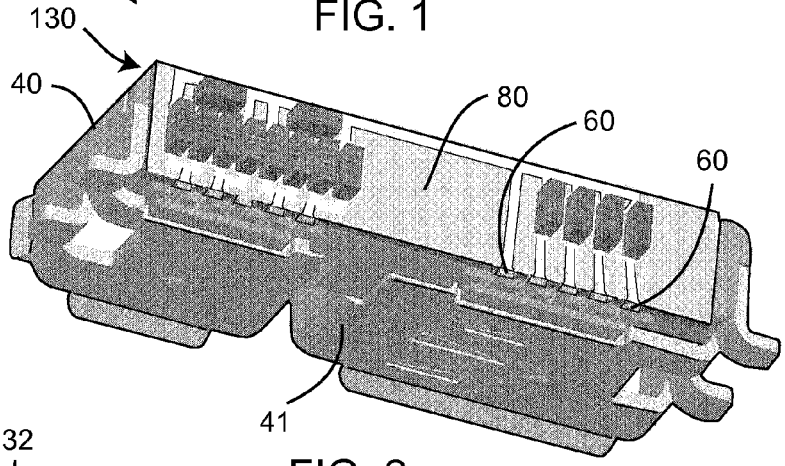
FIG. 2 is a rear perspective view of the invention.
Figure 3:
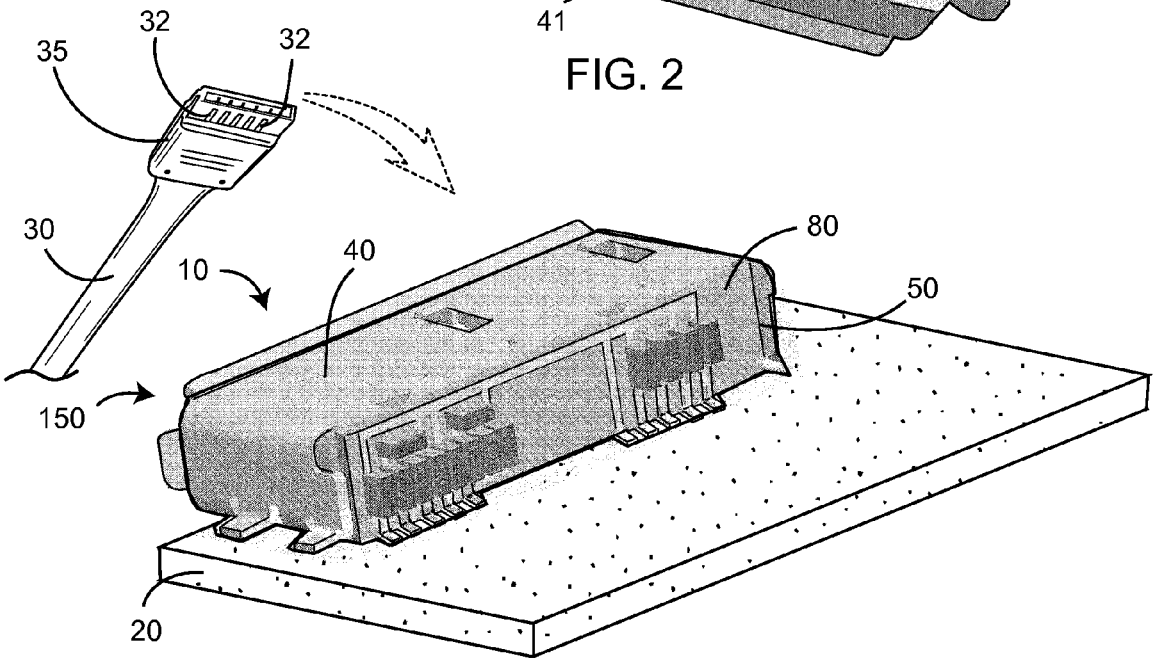
FIG. 3 is a rear perspective view of the invention as fixed with a circuit board.

FIGS. 1-3 illustrate an electrical connector 10 for connecting a circuit board 20 to a plug 35 of an electric cable 30 that has at least one electrical conductor 32, such as a USB cable 30 (FIG. 4), an HDMI cable 30 (FIG. 7), or the like.

Figure 8:
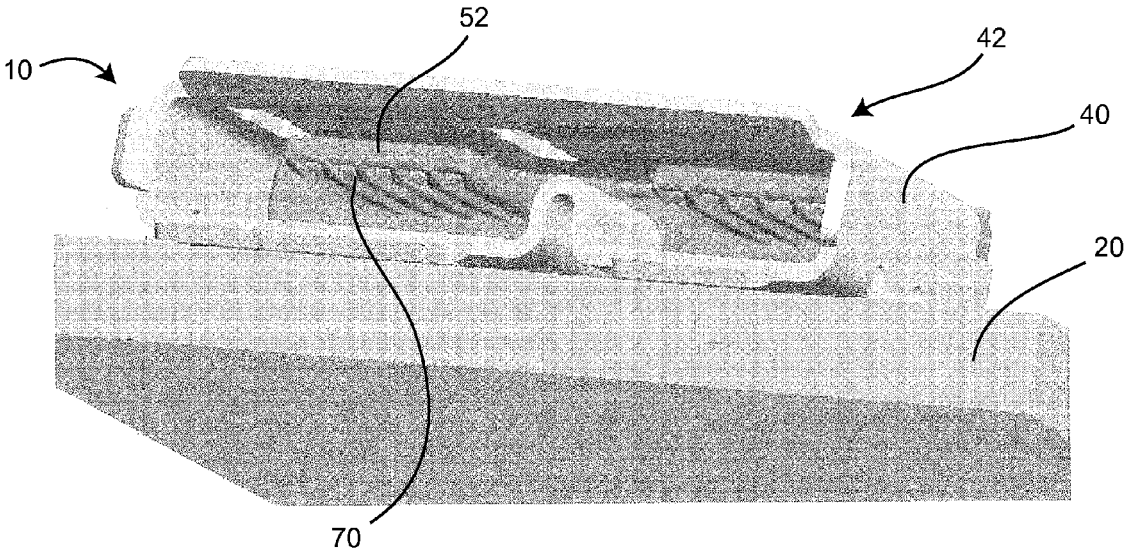
FIG. 8 is a front perspective view of the embodiment of FIG. 5.

The electrical connector 10 includes a rigid housing 40 that has at least a front end 42 (FIG. 8), a lower end 41 adapted for mounting to the circuit board 20, and a rear end 48. Preferably the housing 40 is made from a metal sheet material, but may also be injection molded from a strong, rigid plastic.

A rigid insert 50 is adapted to fit with or within the housing 40 and includes an open front end 52 adapted to receive the plug 35 of the electric cable 30. The housing 40 and insert 50 may each include at least one cooperative mechanical snap arrangement 130 for fixing the insert 50 into the housing 40 in a proper relative position. The insert 50 is preferably made from a plastic injection molded process. A plurality of lower rear conductors 60 project away from a rear end 58 of the insert 50. A plurality of insert conductors 70 are adapted to convey electrical signals between the conductors 32 of the plug 30 and the plurality of lower rear conductors 60, and may traverse the insert 50 or be fixed to an outside surface thereof.

Figure 7:
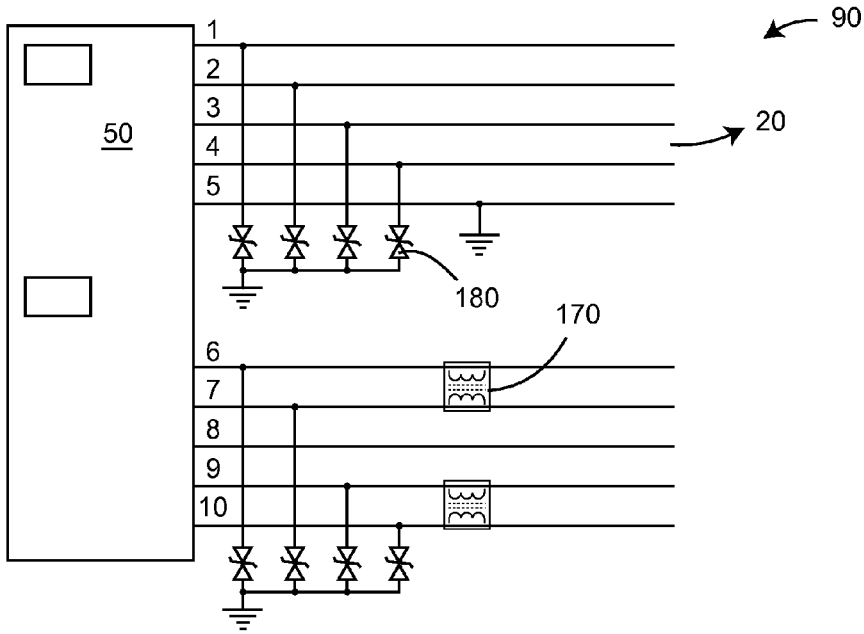
FIG. 7 is a circuit diagram of one embodiment of a modifier circuit of the invention.

A modifier circuit board 80 is adapted for attachment to the insert 50 and for modifying electrical signals between the lower rear conductors 60 of the insert 50 through a modifier circuit 90 (FIG. 7). The term circuit board used herein may refer to a rigid or flexible substrate having circuit components applied thereto or thereon through printing, etching, soldering, or the like. The circuit board 80 is preferably adapted to fit with the rear end 58 of the insert 50, but may also be adapted for fitting with a top side of the insert 50, or either lateral side of the insert 50 (not shown).

Figure 5:
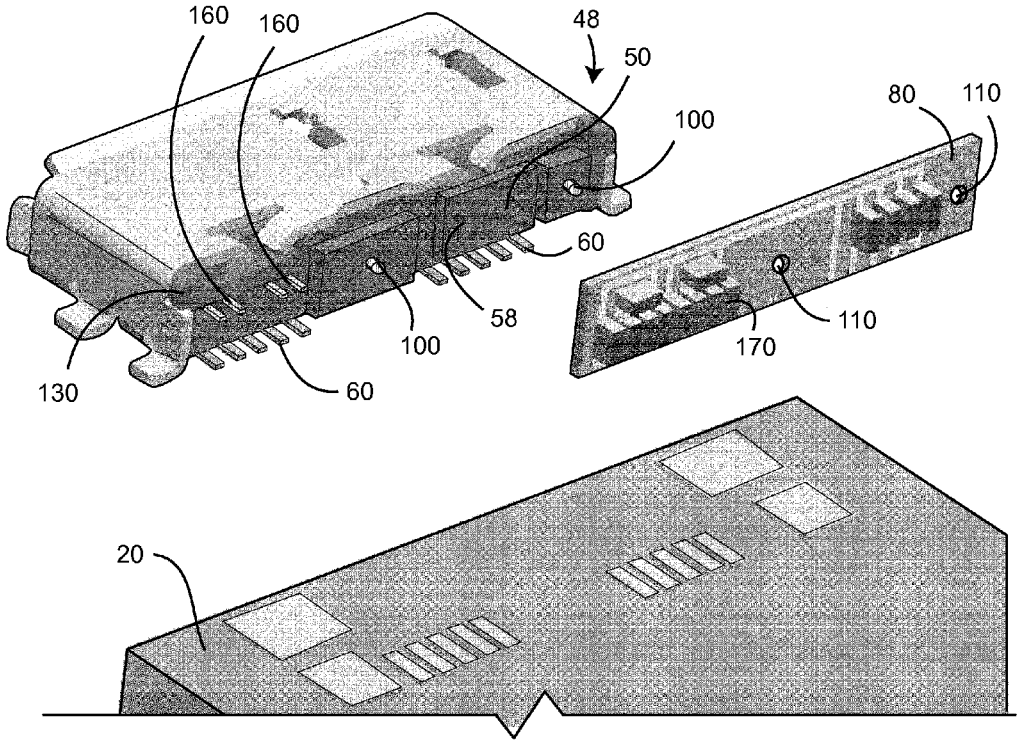
FIG. 5 is an exploded rear perspective view of yet another embodiment of the invention.

In one embodiment, the insert 50 includes at least one indexing prong 100 projecting away from the rear end 58 of the insert 50, and the modifier circuit board 80 includes a cooperative indexing aperture 110 adapted to receive the indexing prong 100 of the insert 50 for facilitating proper alignment of the modifier circuit board 80 with the lower rear conductors 60. For example, with such indexing prongs 100 and indexing apertures 110, the modifier circuit board 80 cannot be fixed with the insert 50 backwards or upside down, since preferably the pattern created by the indexing prongs 100 and indexing apertures 110 is asymmetric with respect to both the longitudinal or transverse axes of a rectangular modifier circuit board 80, for example (FIG. 5). Alternate methods of attaching the modifier circuit board 80 with the insert 50 include adhesives, soldering, press-fit or friction-fit type of attachment structures (not shown), ultrasonic welding, or the like.

Figure 6:
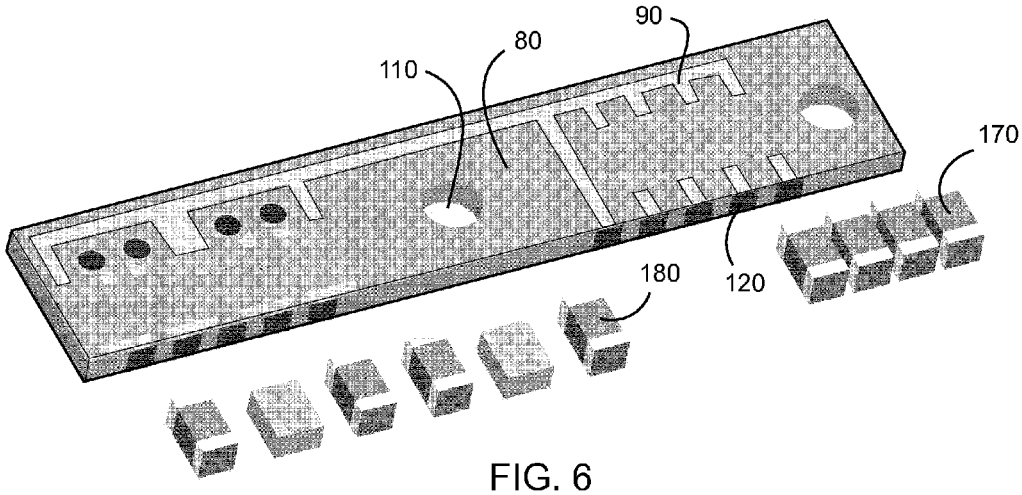
FIG. 6 is an exploded perspective view of a modifier circuit board of the invention.

In one embodiment, the modifier circuit board 80 includes conductor pads 120 on a lower edge 82 thereof, the conductor pads 120 adapted to contact the lower rear conductors 60 of the insert 50 (FIG. 6).

Figure 4:
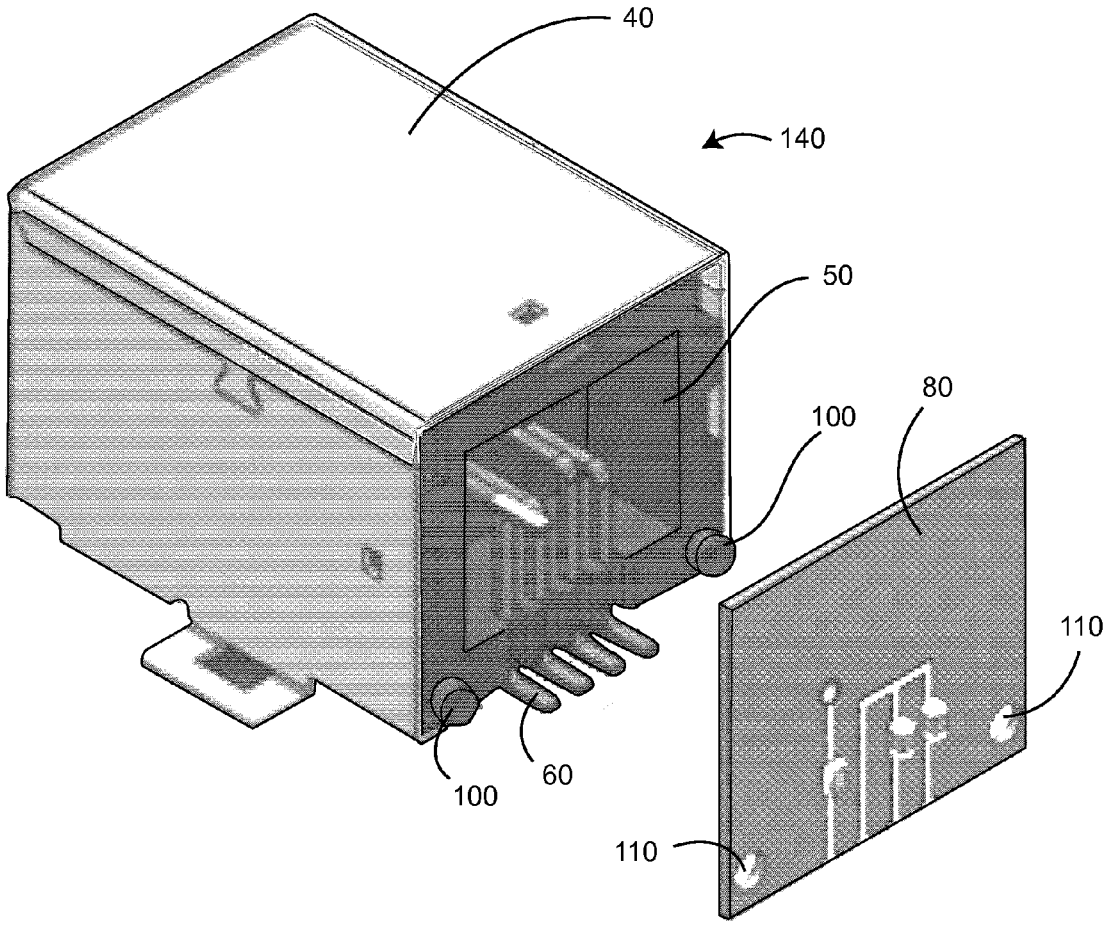
FIG. 4 is an exploded rear perspective view of another embodiment of the invention.
Figure 9:
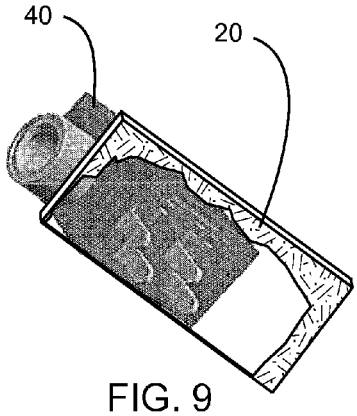
FIG. 9 is a perspective view of an embodiment wherein the connector is an audio cable connector.
Figure 10:
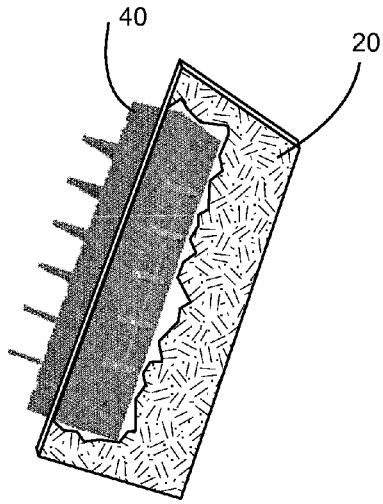
FIG. 10 is a perspective view of an embodiment wherein the connector is a barrier strip cable connector.
Figure 11:
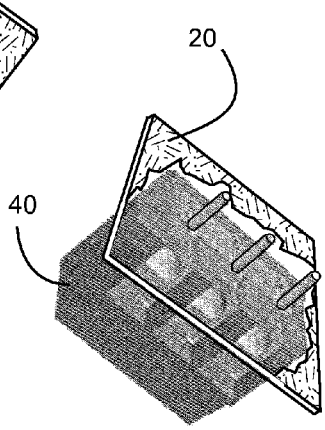
FIG. 11 is a perspective view of an embodiment wherein the connector is a European-style terminal block cable connector.
Figure 12:
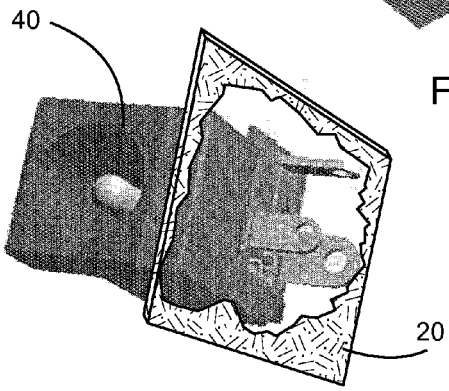
FIG. 12 is a perspective view of an embodiment wherein the connector is DC power cable connector.
Figure 13:
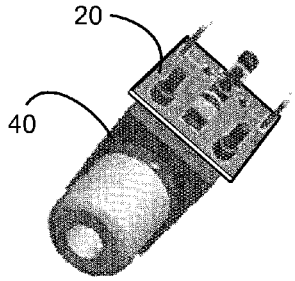
FIG. 13 is a perspective view of an embodiment wherein the connector is an RCA-type cable connector.

The housing 40 and insert 50 may form a USB connector 140 (FIG. 4). Alternately, the housing 40 and insert 50 form an HDMI connector 150 (FIGS. 1-3, 5 and 8), an audio cable connector (FIG. 9), a barrier strip cable connector (FIG. 10), a European-style terminal block cable connector (FIG. 11), a DC power cable connector (FIG. 12), an RCA-type cable connector (FIG. 13), or other types of connector as required.

In one embodiment, the insert 50 further includes a plurality of upper rear conductors 160 (FIG. 5) projecting away from the rear end 58 of the insert 50. In such an embodiment, the lower rear conductors 60 may not necessarily be connected directly to associated electrical conductors 32 of the electric cable 30, but may be more considerably modified by the modifier circuit 90, such as with an inductive choke device 170 or diode device 180 (FIGS. 6 and 7). In such an embodiment, the modifier circuit board 80 preferably includes apertures 161 therein for receiving the upper rear conductors 160 and for connecting the upper rear conductors 160 electrically to the modifier circuit 90.

In use, with the insert 50 fixed with the housing 40 and the modifier circuit board 80 fixed with the rear end 58 of the insert 50, and with the housing 40 and the lower rear conductors 60 fixed with the circuit board 20, the electrical signals from the electric cable 30 plugged into the connector 10 are conveyed to the circuit board 20 as modified by the modifier circuit 90.

While a particular form of the invention has been illustrated and described, it will be apparent that various modifications can be made without departing from the spirit and scope of the invention. For example, conductors 32 of the plug 35 in the figures are shown directly connected to the lower rear conductors 60, but in the embodiment having the upper rear conductors 160 some or all of the lower rear conductors 60 may not be directly connected to the conductors 32 of the plug 35 but rather only indirectly so through the modifier circuit 90. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An electrical connector for connecting a circuit board to a plug of an electric cable that has at least one electrical conductor therein, the electrical connector comprising:

a rigid housing having at least a front end, a lower end adapted for mounting to the circuit board, and a rear end;

a rigid insert adapted to fit within the housing and including an open front end adapted to receive the plug of the electric cable, a plurality of lower rear conductors projecting away from a rear end of the insert, a plurality of insert conductors adapted to convey electrical signals between the conductors of the plug and the plurality of lower rear conductors; and a modifier circuit board adapted for attachment with the insert and for modifying electrical signals between the lower rear conductors of the insert through a modifier circuit;

whereby with the insert fixed with the housing and the modifier circuit board fixed with the rear end of the insert, and with the housing and lower rear conductors fixed to the circuit board, the electrical signals from the electric cable plugged into the connector are conveyed to the circuit board as modified by the modifier circuit.

2. The electrical connector of claim 1 wherein the insert includes at least one indexing prong projecting away from the rear end thereof, and wherein the modifier circuit board includes a cooperative indexing aperture adapted to receive the indexing prong of the insert for facilitating proper alignment of the modifier circuit board with the lower rear conductors at the rear end of the insert.

3. The electrical connector of claim 2 wherein the insert includes exactly two of the indexing prongs and the modifier circuit board includes exactly two of the cooperative indexing apertures.

4. The electrical connector of claim 1 wherein the modifier circuit board includes conductor pads on a lower edge thereof, the conductor pads adapted to contact the lower rear conductors of the insert.

5. The electrical connector of claim 1 wherein the housing and insert include at least one cooperative mechanical snap arrangement for fixing the insert into the housing in a proper relative position.

6. The electrical connector of claim 1 wherein the housing and insert form a USB connector.

7. The electrical connector of claim 1 wherein the housing and insert form an HDMI connector.

8. An electrical connector for connecting a circuit board to a plug of an electric cable that has at least one electrical conductor therein, the electrical connector comprising:

a rigid housing having at least a front end, a lower end adapted for mounting to the circuit board, and a rear end;

a rigid insert adapted to fit within the housing and including an open front end adapted to receive the plug of the electric cable, a plurality of upper rear conductors projecting away from a rear end of the insert, a plurality of insert conductors adapted to convey electrical signals between the conductors of the plug and the plurality of upper rear conductors, a plurality of lower rear conductors projecting away from a rear end of the rigid insert; and a modifier circuit board adapted for attachment with the insert and for conducting electrical signals from the upper rear conductors of the insert to the lower rear conductors of the insert through a modifier circuit;

whereby with the insert fixed with the housing and the modifier circuit board fixed with the rear end of the insert, and with the connector and lower rear conductors fixed to the circuit board, the electrical signals from the electric cable plugged into the connector are conveyed to the circuit board as modified by the modifier circuit.

9. The electrical connector of claim 8 wherein the upper and lower rear conductors are electrically connected within the insert.

10. The electrical connector of claim 8 wherein the insert includes at least one indexing prong projecting away from the rear end thereof, and wherein the modifier circuit board includes a cooperative indexing aperture adapted to receive the indexing prong of the insert for facilitating proper alignment of the modifier circuit board with the upper and lower rear conductors at the rear end of the insert.

11. The electrical connector of claim 10 wherein the insert includes exactly two of the indexing prongs and the modifier circuit board includes exactly two of the cooperative indexing apertures.

12. The electrical connector of claim 8 wherein the modifier circuit board includes conductor pads on a lower edge thereof, the conductor pads adapted to contact the lower rear conductors of the insert.

13. The electrical connector of claim 8 wherein the modifier circuit connects one of the upper rear conductors to one of the lower rear conductors.

14. The electrical connector of claim 8 wherein the modifier circuit connects one of the upper rear conductors to one of the lower rear conductors in parallel with a inductive choke device.

15. The electrical connector of claim 8 wherein the housing and insert include at least one cooperative mechanical snap arrangement for fixing the insert into the housing in a proper relative position.

16. The electrical connector of claim 8 wherein the housing and insert form a USB connector.

17. The electrical connector of claim 8 wherein the housing and insert form an HDMI connector.

18. The electrical connector of claim 8 wherein the housing and insert form an audio cable connector.

19. The electrical connector of claim 8 wherein the housing and insert form a DC power cable connector.

20. The electrical connector of claim 8 wherein the housing and insert form an RCA-type cable connector.

* * * * *